United States Patent [19]

Nakasugi et al.

[11] 4,219,371

[45] Aug. 26, 1980

[54] PROCESS FOR PRODUCING HIGH-TENSION BAINITIC STEEL HAVING HIGH-TOUGHNESS AND EXCELLENT WELDABILITY

[75] Inventors: Hajime Nakasugi, Kimitsu; Masana Imagumbai, Kisarazu; Hiroshi Tamehiro, Kimitsu, all of Japan

[73] Assignee: Nippon Steel Corporation, Tokyo, Japan

[21] Appl. No.: 27,393

[22] Filed: Apr. 5, 1979

[30] Foreign Application Priority Data

Apr. 5, 1978 [JP] Japan ..... 53/40092

[51] Int. Cl.[2] ..... C21D 7/14

[52] U.S. Cl. ..... 148/12 F; 75/123 N; 148/12.3

[58] Field of Search ..... 148/12 F, 12.3, 12.4, 148/12 R; 75/123 N

[56] References Cited

U.S. PATENT DOCUMENTS

| | | | |
|---|---|---|---|
| 3,849,209 | 11/1974 | Ishizaki et al. | 148/12 F |
| 3,857,740 | 12/1974 | Gondo et al. | 148/12.3 |
| 3,904,447 | 9/1975 | Gondo et al. | 148/12.3 |
| 3,925,111 | 12/1975 | Takechi et al. | 148/12 F |
| 3,951,696 | 4/1976 | Gondo et al. | 148/12 F |
| 4,058,414 | 11/1977 | Matsuoka | 148/12 F |
| 4,105,474 | 8/1978 | Nakasugi et al. | 148/12 F |
| 4,115,155 | 9/1978 | Roe | 148/12 F |
| 4,137,104 | 1/1979 | Nashiwa et al. | 75/123 N |
| 4,138,278 | 2/1979 | Nakasugi et al. | 148/12 F |

*Primary Examiner*—L. Dewayne Rutledge
*Assistant Examiner*—Peter K. Skiff
*Attorney, Agent, or Firm*—Wenderoth, Lind & Ponack

[57] ABSTRACT

A process for producing high-tension bainitic steel having high-toughness and excellent weldability by subjecting a bainitic steel of a specific composition to a low-temperature heating and subsequently rolling the steel under specific conditions.

4 Claims, 4 Drawing Figures

PROCESS FOR PRODUCING HIGH-TENSION BAINITIC STEEL HAVING HIGH-TOUGHNESS AND EXCELLENT WELDABILITY

BACKGROUND OF THE INVENTION

1. Field of the Invention

This invention relates to a process for producing a hightension bainitic steel sheet having excellent weldability and low-temperature toughness.

The incessant growth in demand for energy in recent years has led to a great increase in the construction of pipelines as economical means of transportation for oil and natural gas. Moreover, a good many deposits of oil and natural gas have been discovered in the coastal regions bordering on the Arctic Ocean and in Siberia. Today's pipelines, therefore, are required to transport large volumes of gas and oil over great distances. For reasons of economy, both diameter and operation pressure of pipelines have become increased. Thus, the steel sheets used for making these pipes are required to possess high strength of the API X-70 class and excellent low-temperature toughness.

Further, to ensure high efficiency in the field welding of these pipes, an automatic welding method of low heat-input has come into wide use. To prevent hardening and weld cracks in the heat-affected zone (hereinafter abbreviated to HAZ) of a welded joint, the requirements for good weldability have become ever more severe.

2. Description of the Prior Art

Most steel sheets for use in pipelines have heretofore been produced by subjecting ferrite-pearlite steel containing grain-refining and precipitation hardening elements such as of Nb and V to a method known as "controlled rolling" (hereinafter abbreviated as CR). However, the requirements for added strength, toughness and weldability of steel sheets for use in pipelines have now grown so severe that it has become exceedingly difficult to satisfy them with conventional ferrite-pearlite steel.

To satisfy these requirements, there have been developed and put to use Pearlite Reduced Steel (hereinafter abbreviated as PRS), the weldability and toughness of which is improved by decreasing the C content and consequently the pearlite content as compared with those of ordinary steel, and Acicular Ferrite Steel (hereinafter abbreviated as AF steel) having a low C content and a high Mn content and containing Nb and Mo. In the former product, however, the deficiency of strength becomes conspicuous in proportion as the wall thickness of the steel sheet increases. Moreover, the toughness and weldability of this product are not entirely satisfactory. In the latter product, although the strength and toughness are nearly satisfactory, the weldability is inferior despite the low-carbon content because the Mn and Mo contents are high and the carbon equivalent (hereinafter abbreviated as Ceq) is consequently high. Besides the two types of steel mentioned above, Bainitic Steel has been developed as a high-tension steel for use in industrial machines, although it has not yet been adapted for use in pipelines. The conventional bainitic steel possesses poor weldability and toughness in the HAZ because the bainitic transformation is accomplished by addition of large amounts of alloy elements such as Mn, Mo and B.

SUMMARY OF THE INVENTION

One object of the present invention is to overcome the various disadvantages of the prior art and to provide a process for producing an inexpensive bainitic steel having a stable and excellent balance of strength, toughness and weldability.

The process according to the present method comprises heating a steel ingot or slab to a temperature not higher than 1150° C. and subsequently rolling the heated ingot or slab under conditions such that the total reduction amount at temperatures not exceeding 900° C. is 60% or more and the finishing temperature falls in the range of from 700° to 800° C., said steel ingot or slab consisting of 0.005 to 0.03% of C, not more than 0.4% of Si, 1.4 2.0% of Mn, not more than 0.008% of S, 0.005 to 0.08% of total Al, 0.01 to 0.08% of Nb, 0.005 to 0.025% of Ti, 0.0008 to 0.0018% of B, 0.001 to 0.005% of N and the balance, to make up 100%, of Fe and unavoidable impurities, and satisfying the expression of $0 \leqq Ti\%-3.4(N\%) \leqq 0.01$.

DESCRIPTION OF THE PREFERRED EMBODIMENTS

The salient features of the bainitic steel of the present invention are as follows:

(1) Improvement in weldability due to an extreme decrease in the C content (0.005 to 0.03% of C), (2) Transformation of rolled structure to bainite by effective use of a small amount of Ti and B and improvement in toughness of matrix and HAZ due to precipitation of fine TiN particles, and (3) Grain-refinement by the CR method following the step of low-temperature heating.

The limitation of the C content to the range of from 0.005 to 0.03% is aimed chiefly at improvement in the weldability. In the construction of a pipeline, pipe joints are subjected to field welding by use of a small amount of heat-input. The welded joints thus obtained by field welding tend to rigidify and give rise to various forms of weld cracks, which may at times lead to ruptures in the pipeline. But it requires enormous expense to eliminate innumerable defects by weld repair. It is, therefore, necessary that due precautions should be exercised during the field welding operation to minimize occurence of weld cracks. For this purpose, it is most important to select a kind of steel sheet which undergoes no appreciable hardening, although the selection of proper welding rods and welding conditions is also fairly important.

Figure 1:
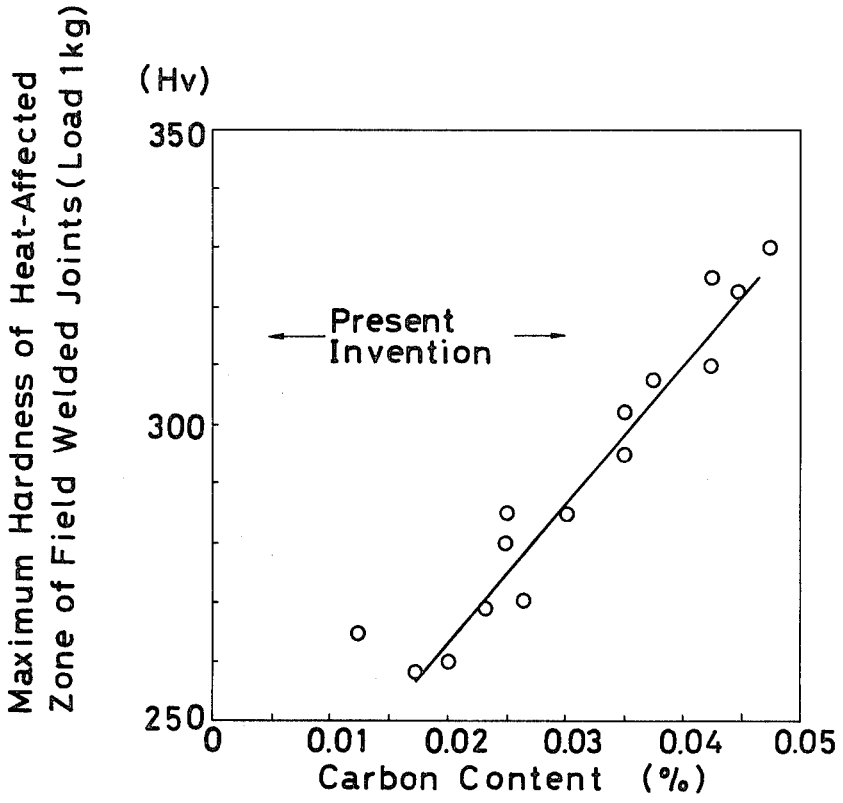
FIG. 1 is a graph showing the relation between the C content and the maximum hardness of the heat-affected zone in field welded joints.

Complete prevention of weld cracks necessitates use of a steel sheet of a quality such that the HAZ in the welded joints has a Vickers hardness (hereinafter abbreviated as $H_v$) of not more than 300. According to the test results indicated in FIG. 1, the upper limit of the C content of the steel sheet for pipelines is 0.03%. Further in bainitic steel, numerous high-carbon martensite islands are formed in the matrix and HAZ in the welded joints and these degrade toughness and resistance to hydrogen-induced cracking. The decreased C content is advantageous for decreasing the absolute amount of martensite islands and dispersing them finer and uniform and, consequently, precluding the aforementioned degradation of important properties. However, when the C content is decreased excessively, the grain refinement effect and the precipitation hardening of Nb and V is degraded and the strength of the matrix and welded joints is substantially impaired. Thus, the lower limit of the C content is fixed at 0.005%.

Figure 2:
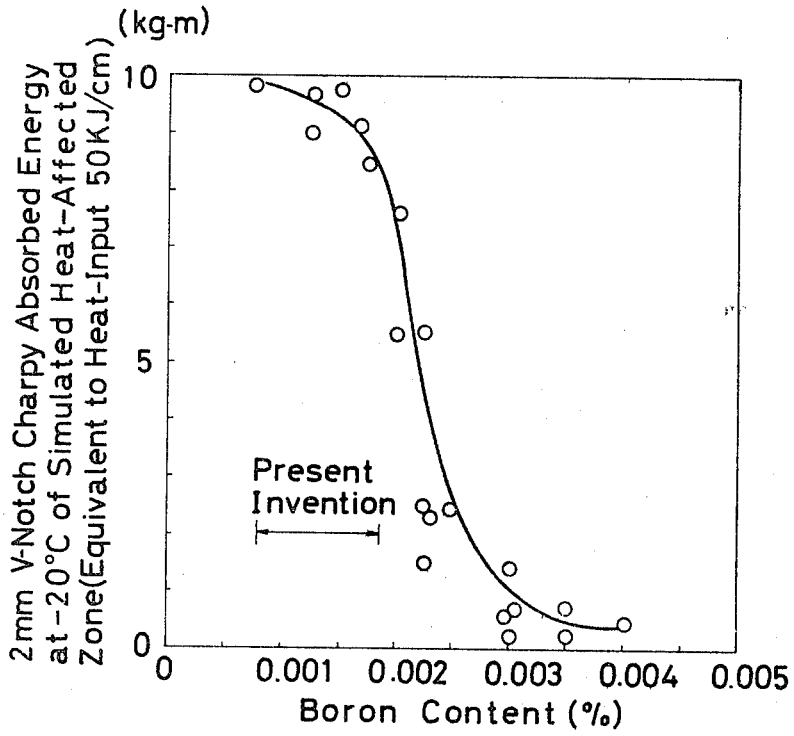
FIG. 2 is a graph showing the relation between the B content and the 2-mm V-notch Charpy absorbed energy at −20° C. in the simulated heat-affected zone (equivalent to heat-input 50 KJ/cm).

Since the decrease in the C content brings about a decline in the strength of the matrix, it is impracticable to realize inexpensive enhancement of the strength of the ferrite-pearlite steel having extremely low carbon content. Thus, the bainitic transformation must be used for the improvement in strength. For this purpose, use of B which is capable of improving the strength proves to be highly effective. Since B is available inexpensively and is highly effective in transforming the rolled structure to bainite, it is an indispensable element for the steel of the present invention. On the other hand, B is definitely detrimental to the toughness of the welded joints, and weldability. This disadvantage applies even to steel of extremely low C content like the steel of the present invention. For this reason, careful attention must be paid to the amount of B to be added to the steel. FIG. 2 is a graph showing the relation between the amount of B added and the toughness of the simulated heat-affected zone. It is noted from this graph that the toughness sharply declines where the amount of B added is in the neighborhood of 0.0018 to 0.0023%. This is because the hardness of HAZ increased extremely and the grain boundary toughness deteriorates with the B-constituent formed at austenite grain boundary when B is added in a large amount. It is, therefore, necessary to fix the upper limit of the amount of B thus added at 0.0018%. On the other hand, for the purpose of ensuring the effect of B on the stabilization of the hardenability, it is necessary to add at least 0.0008% of B. This amount is still larger than is normally required in the heat treatment. (The preferred range of the amount of B thus added is from 0.0010 to 0.0015%.) The added B manifests its effect on the enhancement of hardenability when it is uniformly segregated in the austenite grain boundary at the time the steel is cooled after rolling. It fails to manifest its effect when it forms a precipitate. Thus, proper selection of the amount of solute B is an indispensable requirement for stabilization and improvement of the hardenability. Since B readily reacts with N and forms a nitride BN, it is necessary that N should be fixed by an element capable of forming a more stable nitride. For this purpose, Ti is added to fix N. To ensure the proper amount of solid solute B, the amount of Ti thus added is limited so as to satisfy the expression, $0 \leqq Ti\%-3.4(N\%) \leqq 0.01$. The part, $Ti\%-3.4(N\%) \geqq 0$, of the expression is intended to ensure perfect fixation of N and consequently assure the presence of the proper amount of solid solute B for the purpose described above. The other part, $Ti\%-3.4(N\%) \leqq 0.01$, of the expression is intended to eliminate the possibility of excess Ti relative to N, because any excess of Ti goes to form TiC which has a highly adverse effect upon the toughness of steel.

Further, since the toughness of bainitic steel greatly depends on the grain size, an extreme decrease in the C content alone is not sufficient to enhance the matrix and HAZ toughness of the steel and ensure low-temperature toughness approximate for application to pipelines. It is necessary to refine the grain size of the matrix and HAZ completely. For this purpose, effective use of Ti as an alloy element coupled with well-coordinated definition of heating and rolling conditions, as will be described later, is indispensable. Ti manifests an effect fully in fixing N in the form of TiN and allowing B to fulfil its part of improving the hardenability of steel as described above. Besides, the fine particles of TiN which precipitate in a slab (not larger than $0.05\mu$ in diameter) are effective in decreasing the austenite grain size during the step of heating (hereinafter referred to as "heated $\gamma$ grains") and consequently transforming the rolled structure into fine grains. The fine TiN grains present in the steel sheet are also effective in preventing the austenite grain growth of HAZ at the time of welding.

The coarse TiN particles which are formed by the ordinary steelmaking technique, however, have an adverse effect on the toughness. In order for the added Ti to serve the purpose of enhancing the toughness of the matrix and HAZ of the steel sheet, therefore, it is an essential requirement that the TiN should be precipitated in sufficiently fine particles. For this purpose, it is advantageous to limit simultaneously the Ti and N contents, specifically to the ranges of from 0.005 to 0.025% and from 0.001 to 0.005% respectively. The lower limits of the Ti and N contents represent their irreducible minimum amounts needed for improving the toughness of the matrix and HAZ of the steel sheet. The upper limits are such that when the Ti and N contents exceed them, a large amount of fine TiN particles can not be obtained in the steel sheet and no improvement can be obtained in the toughness of the matrix and HAZ. The fact that the N content is kept at such a low level brings forth a great advantage that even under the conditions such that the added Ti is stoichiometrically sufficient for the fixation of N, B serves the purpose of stabilizing the intended enhancement of hardenability.

In view of the various factors touched upon above, the Ti and N contents are defined to fall in the respective ranges of from 0.005 to 0.025% and from 0.001 to 0.005% and satisfy the expression, $0 \leqq Ti\%-3.4(N\%) \leqq 0.01$.

Now, the reasons for the percentage ranges fixed for the various elements will be described. Of the steel compositions contemplated by the present invention, the composition of the First Invention defined in Claim 1 contains 0.005 to 0.03% of C, not more than 0.4% of Si, 1.4 to 2.0% of Mn, not more than 0.008% of S, 0.005 to 0.08% of total Al, 0.01 to 0.08% of Nb, 0.005 to 0.025% of Ti, 0.0008 to 0.0018% of B and 0.001 to 0.005% of N. The C, Ti, B and N contents are limited for the reasons already described.

Si is an element which inevitably comes into steel in the deoxidation step. Since Si adversely affects the sake of weldability of the steel sheet and toughness in the welded seams, the upper limit of the Si content is fixed at 0.4%. (Since Al alone suffices for the deoxidation of steel, the Si content is preferably less than 0.2%.)

Mn is a very important element because it lowers the transformation temperature of steel, heightens the CR effect upon the improvement of steel quality, facilitates the bainitic transformation and improves both strength and toughness. When the Mn content is less than 1.4%, the bainitic transformation does not occur sufficiently and the desired improvement in strength and toughness is not attained. Thus, the lower limit is fixed at 1.4%. When the Mn content is too high, the hardenability of HAZ is increased so much as to give rise to martensite islands in spite of the very low C content of the order contained in this invention, the toughness of the matrix and HAZ is degraded, and the carbon equivalent is heightened to the extent of impairing the weldability. Thus, the upper limit is fixed at 2.0%. (The preferred range of the Mn content is from 1.6 to 1.9%.)

Al is an element which inevitably comes into the killed steel in the deoxidation step. When the total Al content is less than 0.005%, the deoxidation is not effected sufficiently and the toughness of the matrix is not sufficient. Thus, the lower limit is fixed at 0.005%. When the total Al content is greater than 0.08%, the toughness of HAZ falls short of the acceptable level. Thus, the upper limit is fixed at 0.08%. When N is fixed by Al and no solid solution of AlN is produced in the step of heating, the Al serves the purpose of promoting the effect of B on the improvement of hardenability, similarly to Ti.

Nb is an important element which is added for the purpose of grain refinement and precipitation hardening. This element improves both strength and toughness. In the steel of this invention which is bainite in structure, this element cooperates with Mn and B to accelerate the bainitic transformation. This effect of Nb is not sufficiently obtained where the Nb content is less than 0.01%. When the Nb content is greater than 0.08%, the element is detrimental to the weldability of the steel sheet and the toughness of welded seams. Thus, the Nb content is limited to a range of from 0.01 to 0.08%.

In the case of S, which is an impurity, the content is defined to be not more than 0.008%. In a pipeline of large diameter and increased resistance to pressure to be used in a district of severe cold climate, the matrix and welded seams are required to provide high absorption energy from the viewpoint of preventing unstable ductile fracture. For the purpose of increasing the impact value of the steel sheet, the S content is limited as defined above. The toughness improves in proportion as the S content is lowered. This improvement is particularly conspicuous when the S content is below 0.001%.

The steel of this invention also contains P as another impurity. Normally, the P content is less than 0.03%. The toughness and weldability of the matrix and welded seams improve in proportion as the P content is decreased.

The steel of the Second Invention indicated in Claim 2, which employs the same manufacturing process as the First Invention Defined in Claim 1, additionally comprises either or both of 0.001 to 0.03% of REM (rare earth metal) and 0.0005 to 0.005% of Ca and, where REM is contained, limits the ratio of (REM%)/(S%) in the range between 1 and 10. Consequently, the steel of the Second Invention is decidedly superior in toughness and hydrogen-induced cracking resistance property.

REM and/or Ca spheroidizes MnS and improves the impact value and prevents the occurrence of defects due to the combined effect of the MnS elongated by the CR and the hydrogen. No practical effect of REM is produced when the REM content is less than 0.001%. Addition of REM in an amount greater than 0.03% causes formation of a large amount of REM-S or REM-O-S so that large inclusions are formed which impair not only the toughness but also the cleanness of the steel sheet, and consequently produces an adverse effect on the weldability. REM, in its correlation with S, is effective in improving and stabilizing toughness. The optimum range of the REM content, therefore, is such as to satisfy the expression $1 \leqq (REM\%)/(S\%) \leqq 10$. Ca has an effect similar to the effect of REM. The effective range of the Ca content is from 0.0005 to 0.005%.

The steels of the Third and Fourth Inventions defined in Claims 3 and 4 which employ the same manufacturing process as the First and Second Inventions defined in Claims 1 and 2 additionally comprise at least one member selected from the group of 0.01 to 0.10% of V, 0.1 to 1.0% of Cr, 0.05 to 0.30% of Mo, 0.1 to 1.0% of Cu and 0.1 to 2.0% of Ni and satisfy the expression $Mn+Cr+2Mo \leqq 2.4$. The main reason for addition of these elements is to improve the strength and toughness of the steel product of this invention and to expand the feasible steel sheets thickness range. Naturally, the addition of these elements is limited as concerns their amount.

V is added for the purpose of refining the grain size of the rolled structure and obtaining the precipitation hardening. It serves to improve both strength and toughness. The effect of this element is not sufficiently attained when its content is less than 0.01%. When the content exceeds 0.10%, however, the excess amount of addition has an adverse effect upon the weldability and the toughness of welded joints. Thus, the upper limit of the content is fixed at 0.10%.

Since Cr is an inexpensive element capable of accelerating the bainitic transformation, improving strength, toughness and environmental corrosion resistance, it enjoys a high value of utility. When this element is added excessively, it brings forth a disadvantage that the hardenability of HAZ is increased and the toughness and crack-resisting property are degraded. Thus, the upper limit of its content is fixed at 1.0%.

Among the various additive elements for the steel of the present invention, Mo is as important as Ni. Cooperating with Mn, Nb and B, this element Mo produces a notable effect in stabilizing the bainite structure and decreasing the effective grain size of bainitic structure. This effect is particularly conspicuous when it is added in combination with Ni.

When Mo is added excessively, however, it causes a serious degradation in the toughness of welded seams and the weldability of the steel sheet. Thus, the upper limit of the Mo content must be fixed at 0.30%. (The most preferable range of the Mo content is from 0.10 to 0.20%.)

Ni is a particularly desirable element in the respect that it improves the strength and toughness of the matrix and the toughness of welded seams without producing any adverse effect upon the weldability. As described above, Ni when used in combination with Mo improves the strength and toughness of bainitic steel to an outstanding extent. When Ni is added in an amount exceeding 2.0%, it has an undesirable effect upon the weldability and the toughness of welded seams. Thus, the upper limit of the Ni content is fixed at 2.0%.

Cu has substantially the same effect as Ni and further improves the environmental corrosion resistance. Even in the case of the bainitic steel of this invention having an extremely low C content, Cu serves to improve the strength by virtue of solution and/or precipitation hardening. Thus, this is a valuable element for the present invention. When the Cu content exceeds 1.0%, however, Cu-cracking occurs during the hot rolling, and this makes it difficult to produce the steel sheet intended by this invention. Thus, the upper limit of the Cu content is fixed at 1.0%.

The lower limits of the Cr, Mc, Ni and Cu contents are the prefarable minimum amounts needed for bringing about the effects upon the property of the product. Thus, the lower limits are 0.05% for Mo and 0.1 for Cr, Ni and Cu.

Further, the above addition elements should not be added independently within their respective ranges. To obtain outstanding improvement in the weldability and the toughness of welded seams, their contents must be selected so that they satisfy the expression, $Mn+Cr+2Mo \leqq 2.4$.

Even when the steel compositions are rigidly limited as described above, outstanding strength and toughness are not attained where the hot rolling conditions are improper. Thus, the present invention further defines the hot rolling conditions.

Figure 3:
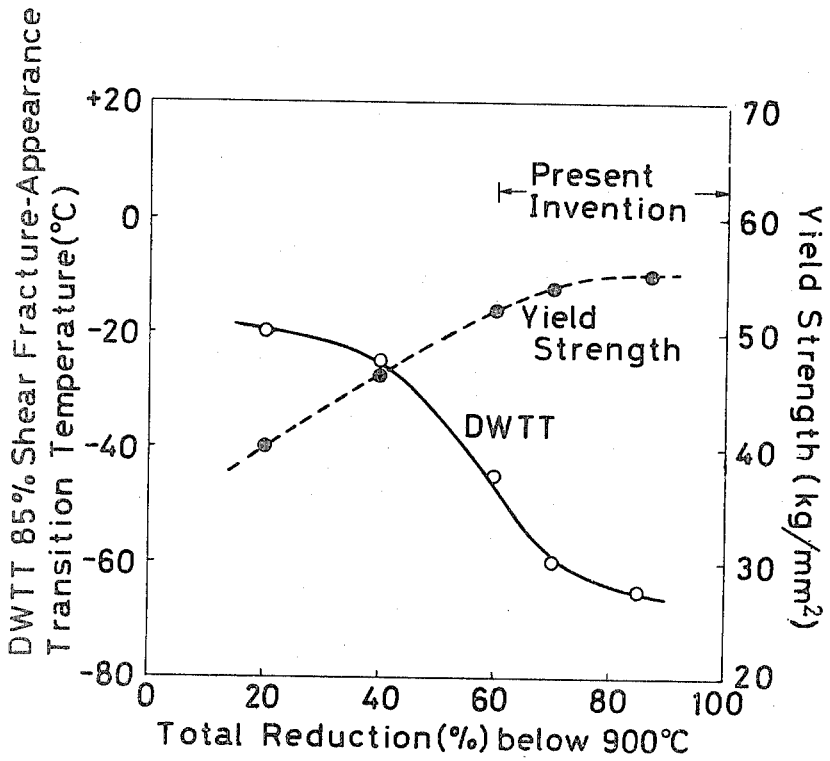
FIG. 3 is a graph showing the relation between the total reduction amount at temperatures not exceeding 900° C. and the yield strength as well as DWTT 85% shear fracture-apperance transition temperature, as determined by the steel of this invention.
Figure 4:
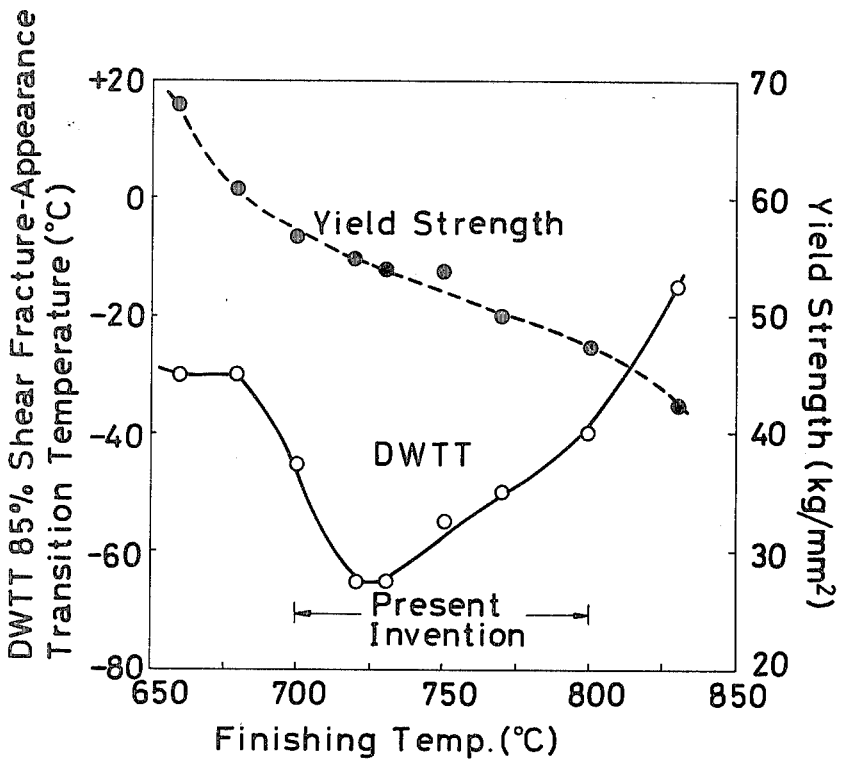
FIG. 4 is a graph showing the relation between the finishing temperature and the yield point strength as well as DWTT 85% fracture-appearance transition temperature, as determined by the steel of this invention.

As described previously, the toughness of the bainitic steel greatly depends on the grain size. The steel, therefore, fails to obtain sufficient low-temperature toughness unless the structure is sufficiently refined. For this purpose, the size of the heated $\gamma$ grains must be decreased as much as possible. Thus, the upper limit of the heating temperature is fixed at 1150° C. The reason for this upper limit of 1150° C. is that when the heating temperature exceeds this limit, the fine TiN particles precipitated in the steel slab begin to grow in size and the prevention effect on the coarsening of the heated $\gamma$ grains and HAZ by TiN becomes unstable. The preferred range of heating temperature, therefore, is from 900° to 1050° C. No matter how much the size of heated $\gamma$ grains may be decreased, a steel sheet possessing a high strength and outstanding low-temperature toughness cannot be produced simply in an ordinary rolling. Thus, the rolling conditions are also limited. In the present invention, the rolling conditions are defined so that the total reduction amount at temperatures not exceeding 900° C. is 60% or more and the finishing temperature measured at the center of thickness falls in the range of from 700° to 800° C. When the rolling is carried out under these conditions, the steel sheet acquires a notable improvement in strength and toughness. The reasons for the limits on the rolling conditions are described as follows. Thus, when the total reduction amount at temperatures not exceeding 900° C. is 60% or more, both yield strength and toughness are improved greatly as shown in FIG. 3. When the total reduction amount is less than 60%, high strength and outstanding toughness are not obtained. Even when the total reduction amount at temperatures not exceeding 900° C. is 60% or over, the produced steel sheet exhibits neither the outstanding yield strength nor the high toughness as shown in FIG. 4 when the finishing temperature exceeds 800° C.

Insofar as the ranges of steel compositions and the conditions of hot rolling specified for the steel products of this invention are satisfied, a slight degree of rolling performed in the ferriteaustenite zone or the ferrite zone brings about a desirable effect upon the low-temperature toughness. Thus, the lower limit of the finishing temperature is fixed at 700° C.

Regarding the cooling after the rolling, the steel sheet is naturally cooled by air convection, but forced cooling with sprayed water, mist or air is additionally effective in promoting the bainitic transformation and decreasing the grain size. In this case, the cooling rate is desired to fall in the range of from 0.5 to 20° C./second.

Heat treatment of the hot rolled steel sheet at a temperature not exceeding the $A_{C1}$ transformation point does not impair the characteristic properties of the steel products of this invention. This treatment is effective in improving the yield strength through decomposition of martensite islands and decreasing the hydrogen content.

The steel slabs and ingots in this invention can be produced by either the ingot process or the continuous casting process. The latter process is advantageous over the former process, since the cooling rate of the molten steel is so high that a greater amount of fine TiN particles can be obtained. Possible hot-rolling processes include hot strips, heavy plate and various shape steels.

Table 1 and Table 2 indicate working examples of the process of this invention and comparative examples. In all cases, the results are obtained for steel sheets.

The steel sheets of the working examples produced by the process of this invention invariably exhibit excellent strength, low-temperature toughness and weldability in good balance. In contrast, the steel sheets of the comparative examples produced without satisyfing either the limits of the compositions or the conditions of production have critical faults as welding steel products, being deficient in welding properties despite the outstanding properties of their matrices.

As described above, this invention makes possible the production of pipeline grade steel sheets under as rolled or tempered conditions, which have a good balance of strength, toughness and weldability, by subjecting a bainitic steel of a specific composition to a low-temperature heating and subsequently rolling under specific conditions.

Table 1

| | Steel No. | Chemical Composition (%) C | Si | Mn | S | Al | Nb | Ti | B | N | Ti-3.4N | Production Conditions: Other Elements | Heating Temp. (°C.) | Total Reduction (%) below 900° C. | Finishing Temp. (°C.) | Final Thickness (mm) | Remarks |
|---|---|---|---|---|---|---|---|---|---|---|---|---|---|---|---|---|---|
| Present Invention | 1 | 0.012 | 0.03 | 1.92 | 0.002 | 0.021 | 0.036 | 0.016 | 0.0013 | 0.0032 | 0.005 | — | 1150 | 70 | 720 | 20 | As rolled |
| | 2 | " | " | " | " | " | " | " | " | " | " | — | 1000 | 65 | 705 | " | " |
| | 3 | 0.024 | 0.21 | 1.76 | 0.0008 | 0.023 | 0.045 | 0.021 | 0.0017 | 0.0041 | 0.007 | REM 0.005 REM/S = 6.3 | 1050 | 75 | 720 | 15 | " |
| | 4 | " | " | " | " | " | " | " | " | " | " | Ca 0.002 | " | 70 | 730 | " | " |
| Comparison | 5 | 0.026 | 0.13 | 1.87 | 0.002 | 0.026 | 0.047 | 0.041 | 0.0013 | 0.0052 | 0.023 | — | " | 75 | 720 | 15 | " |
| | 6 | 0.012 | 0.65 | 1.81 | 0.004 | 0.018 | 0.036 | 0.023 | 0.0016 | 0.0062 | 0.002 | — | 1150 | " | 710 | 20 | " |
| | 7 | 0.020 | 0.08 | 1.79 | 0.001 | 0.024 | 0.042 | 0.014 | 0.0032 | 0.0035 | 0.002 | Ca 0.002 | 1000 | 70 | 715 | 15 | " |
| | 8 | 0.046 | 0.20 | 1.80 | 0.002 | 0.030 | 0.037 | 0.012 | 0.0012 | 0.0031 | 0.001 | — | 1200 | " | 710 | " | " |

| | Steel No. | [1]Properties of Base Metal: Yield Strength (kg/mm²) | Tensile Strength (kg/mm²) | 2vE-60° C. (kg-m) | vTrs (°C.) | [2]DWTT 85% Shear Fracture-appearance | [3]Properties of Welded Joints 2vE-20° C. (kg-m) | Weldability [4]Max. Hardness Hv (1 kg) |
|---|---|---|---|---|---|---|---|---|
| Present Invention | 1 | 50.3 | 62.7 | 20.3 | − 110 | − 45 | 6.2 | 248 |
| | 2 | 49.7 | 61.3 | 24.2 | − 120 | − 60 | 7.4 | " |
| | 3 | 49.8 | 60.8 | 32.6 | < − 120 | − 70 | 9.1 | 262 |
| | 4 | 48.2 | 59.9 | 35.1 | " | − 75 | 12.3 | " |
| Comparison | 5 | 51.1 | 65.5 | 14.3 | − 90 | − 30 | 0.8 | 273 |
| | 6 | 49.2 | 61.2 | 13.7 | − 95 | − 20 | 2.1 | 250 |
| | 7 | 48.5 | 64.0 | 20.5 | − 105 | − 45 | 0.7 | 280 |
| | 8 | 44.9 | 65.6 | 5.8 | − 65 | − 15 | 1.5 | 341 |

[1]Value of transverse direction.
[2]DWTT 85% shear fracture-appearance transition temperature obtained by the method at API standard SR6.
[3]Value of simulated heat-affected zone (equivalent to heat-input 50 KJ/cm).
[4]Maximum hardness of heat-affected zone. (Welding conditions; heat-input 6 KJ/cm, without preheating)

Table 2

| | Steel No. | Chemical Composition (%) C | Si | Mn | S | Al | Nb | Ti | B | N | Ti-3.4N | Other Elements | Mn + Cr + 2Mo | Production Conditions: Heating Temp. (°C.) | Total Reduction (%) below 900° C. | Finishing Temp. (°C.) | Final Thickness (mm) | Remarks |
|---|---|---|---|---|---|---|---|---|---|---|---|---|---|---|---|---|---|---|
| Present Invention | 1 | 0.017 | 0.16 | 1.73 | 0.002 | 0.019 | 0.040 | 0.019 | 0.0013 | 0.0036 | 0.007 | Ni 0.24 Mo 0.17 | 2.07 | 1050 | 75 | 710 | 20 | Subjected to tempering after rolling (10 min at 550° C.) |
| | 2 | " | " | " | " | " | " | " | " | " | " | Ni 0.24 No 0.17 | 2.07 | 950 | 75 | 705 | 20 | As Rolled |
| | 3 | 0.022 | 0.08 | 1.83 | 0.003 | 0.024 | 0.043 | 0.014 | 0.0015 | 0.0031 | 0.003 | Cr 0.32 Cu 0.31 | 2.15 | 1050 | 70 | 720 | 20 | " |
| | 4 | 0.28 | 0.02 | 1.53 | 0.002 | 0.019 | 0.034 | 0.016 | 0.0012 | 0.0028 | 0.006 | Mo 0.27 | 2.07 | 1000 | 75 | 730 | 22 | " |
| Comparison | 5 | 0.014 | 0.18 | 2.13 | 0.002 | 0.031 | 0.044 | — | 0.0033 | 0.0056 | −0.019 | Mo 0.28 | 2.69 | " | " | 710 | " | " |
| | 6 | 0.024 | 0.28 | 1.81 | 0.002 | 0.040 | 0.054 | 0.036 | 0.0021 | 0.0041 | 0.022 | Mo 0.20 | 2.21 | " | 70 | 725 | 20 | " |
| | 7 | " | " | " | " | " | " | " | " | " | " | Ni 0.31 Mo 0.16 | 2.21 | " | 75 | 720 | " | Subjected to tempering after rolling (10 min at 550° C.) |
| | 8 | 0.020 | 2.18 | | 0.003 | 0.032 | 0.039 | 0.012 | 0.0013 | 0.0028 | 0.002 | Cr 0.40 | 2.58 | 1050 | " | 690 | " | As rolled |

| | Steel No. | Properties of Base Metal: Yield Strength (kg/mm²) | Tensile Strength (kg/mm²) | 2vE-60° C. (kg-m) | vTrs (°C.) | DWTT 85% Shear Fracture-appearance | Properties of Welded Joints 2vE-20° C. (kg-m) | Weldability Max. Hardness Hv (1 kg) |
|---|---|---|---|---|---|---|---|---|
| Present Invention | 1 | 58.5 | 67.1 | 21.6 | <−120 | −60 | 7.9 | 279 |
| | 2 | 52.6 | 63.4 | 18.3 | <−120 | −90 | 8.2 | " |
| | 3 | 48.7 | 61.0 | 25.6 | −120 | −65 | 9.4 | 284 |
| | 4 | 50.1 | 67.2 | 20.9 | −120 | −60 | 6.2 | 296 |
| Comparison | 5 | 54.6 | 71.1 | 8.6 | −110 | −30 | 0.3 | 312 |
| | 6 | 51.0 | 65.2 | 10.1 | −100 | −25 | 0.6 | 290 |
| | 7 | 59.4 | 69.1 | 12.6 | −120 | −35 | 1.6 | 294 |
| | 8 | 54.1 | 63.3 | 11.4 | −100 | −30 | 1.2 | 303 |

What is claimed is:

1. A process for producing a high-tension bainitic steel sheet having high-toughness and excellent weldability, which comprises heating a steel ingot or slab to a temperature not higher than 1150° C. and subsequently rolling the heated steel ingot or slab under conditions such that the total reduction amount at temperatures not exceeding 900° C. is 60% or more and the finishing temperature falls in the range of from 700° to 800° C., said steel ingot or slab consisting of 0.005 to 0.03% of C, not more than 0.4% of Si, 1.4 to 2.0% Mn, not more than 0.008% of S, 0.005 to 0.08% of total Al, 0.01 to 0.08% of Nb, 0.005 to 0.25% of Ti, 0.0008 to 0.0018% of B, 0.001 to 0.005% of N and the balance, to make up 100%, of Fe and unavoidable impurities, and satisfying the expression of $0 \leqq Ti\%-3.4(N\%) \leqq 0.01$.

2. A process for producing a high-tension bainitic steel sheet having high-toughness and excellent weldability, which comprises heating a steel ingot or slab to a temperature not higher than 1150° C. and subsequently rolling the heated steel ingot or slab under conditions such that the total reduction amount at temperatures not exceeding 900° C. is 60% or more and the finishing temperature falls in the range of from 700° to 800° C., said steel ingot or slab consisting of 0.005 to 0.03% of C, not more than 0.4% of Si, 1.4 to 2.0% of Mn, not more than 0.008% of S, 0.005 to 0.08% of total Al, 0.01 to 0.08% of Nb, 0.005 to 0.025% of Ti, 0.0008 to 0.0018% of B, 0.001 to 0.005% of N, at least one member selected from the group consisting of 0.001 to 0.03% of REM and 0.0005 to 0.005% of Ca, and the balance, to make up 100%, of Fe and unavoidable impurities, and satisfying the expression of $0 \leqq Ti\%-3.4(N\%) \leqq 0.01$ and, where REM is present, additionally satisfying the expression of $1 \leqq REM\%\ S\% \leqq 10$.

3. A process for producing a high-tension bainitic steel sheet having high-toughness and excellent weldability, which comprises heating a steel ingot or slab to a temperature not higher than 1150° C. and subsequently rolling the heated steel ingot or slab under conditions such that the total reduction amount at temperatures not exceeding 900° C. is 60% or more and the finishing temperature falls in the range of from 700° to 800° C., said steel ingot or slab consisting of 0.005 to 0.03% of C, not more than 0.4% of Si, 1.4 to 2.0% Mn, not more than 0.008% of S, 0.005 to 0.08% of total Al, 0.01 to 0.08% of Nb, 0.005 to 0.025% of Ti, 0.0008 to 0.0018% of B, 0.001 to 0.005% of N, one or more members selected from the group consisting of 0.01 to 0.10% of V, 0.1 to 1.0% of Cr, 0.05 to 0.30% of Mo, 0.1 to 1.0% of Cu and 0.1 to 2.0% of Ni, and the balance, to make up 100%, of Fe and unavoidable impurities, and satisfying the expressions of $0. \leqq Ti\%-3.4(N\%) \leqq 0.01$ and $Mn+Cr+2Mo \leqq 2.4$.

4. A process for producing a high-tension bainitic steel sheet having high-toughness and excellent weldability, which comprises heating a steel ingot or slab to a temperature not higher than 1150° C. and subsequently rolling the heated steel ingot or slab under conditions such that the total reduction amount at temperatures not exceeding 900° C. is 60% or more and the finishing temperature falls in the range of from 700° to 800° C., said steel ingot or slab consisting of 0.005 to 0.03% of C, not more than 0.4% of Si, 1.4 to 2.0% of Mn, not more than 0.008% of S, 0.005 to 0.08% of total Al, 0.01 to 0.08% of Nb, 0.005 to 0.025% of Ti, 0.0008 to 0.0018% of B, 0.001 to 0.005% of N, at least one member selected from the group consisting of 0.01 to 0.10% of V, 0.1 to 1.0% of Cr, 0.05 to 0.30% of Mo, 0.1 to 1.0% of Cu and 0.1 to 2.0% of Ni, at least one member selected from the group consisting of 0.001 to 0.03% of REM and 0.0005 to 0.005% of Ca, and the balance, to make up 100%, of Fe and unavoidable impurities, and satisfying the expression of $0 \leqq Ti\%-3.4(N\%) \leqq 0.01$ and $Mn+Cr+2Mo \leqq 2.4$ and, where REM is present, additionally satisfying the expression of $1 \leqq REM\%/S\% \leqq 10$.

* * * * *

UNITED STATES PATENT OFFICE

CERTIFICATE OF CORRECTION

Patent No. 4,219,371 Dated August 26, 1980

Inventor(s) Hajime Nakasugi, Masana Imagumbai and Hiroshi Tamehiro

It is certified that error appears in the above-identified patent and that said Letters Patent are hereby corrected as shown below:

Claim 1, line 12, change "0.25%" to --0.025%--.

Claim 2, last line, change "$1 \leq$REM% S%$\leq 10$" to -- $1 \leq$REM%/S%$\leq 10$ --.

Claim 3, line 2 from the bottom, change "$0. \leq$Ti%-3.4(N%)$\leq 0.01$" to -- $0 \leq$Ti%-3.4(N%)$\leq 0.01$ --.

Signed and Sealed this

Seventh Day of April 1981

[SEAL]

Attest:

RENE D. TEGTMEYER

Attesting Officer

Acting Commissioner of Patents and Trademarks